US006406307B2

(12) United States Patent
Bungo et al.

(10) Patent No.: US 6,406,307 B2
(45) Date of Patent: Jun. 18, 2002

(54) ANNULAR ELECTRICAL CONNECTOR ASSEMBLY

(75) Inventors: Edward M. Bungo, Cortland, OH (US); Mark C. Sellnau, Bloomfield Hills, MI (US); Anthony Joseph Corso, Struthers, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/785,118

(22) Filed: Feb. 16, 2001

Related U.S. Application Data

(60) Provisional application No. 60/185,582, filed on Feb. 28, 2000.

(51) Int. Cl.[7] ..... H01R 13/44

(52) U.S. Cl. ..... 439/130; 439/125; 439/913; 73/115; 123/635

(58) Field of Search ..... 439/125, 130, 439/913, 248; 73/115, 119 R, 756; 123/635

(56) References Cited

U.S. PATENT DOCUMENTS 4,903,675 A * 2/1990 Huntzinger et al. ..... 123/635
4,969,352 A * 11/1990 Sellnau ..... 73/115
5,152,274 A * 10/1992 Maekawa ..... 123/635
5,329,809 A 7/1994 Sellnau et al. ..... 73/115
5,407,363 A * 4/1995 Polgar et al. ..... 439/546
5,803,419 A * 9/1998 Nicot ..... 248/224.7
5,823,802 A * 10/1998 Bartley ..... 439/86
6,027,360 A * 2/2000 Jenkins ..... 439/364
6,106,327 A 8/2000 Bungo ..... 439/492
6,139,334 A * 10/2000 Forish et al. ..... 439/56
6,149,336 A * 11/2000 Bartley et al. ..... 123/635

* cited by examiner

*Primary Examiner*—Brian Sircus
*Assistant Examiner*—Hae Moon Hyeon
(74) *Attorney, Agent, or Firm*—Thomas N. Twomey

(57) ABSTRACT

Multiple annular electrical connectors are each positioned floatably through a respective aperture of a tray. A shield plate is secured over the tray by bolts which thread into a cylinder head. The shield plate has holes centered above the apertures for access to spark plugs disposed below. Each annular electrical connector is centered about an annular pressure sensing device which encompasses the spark plug. The inboard side of the electrical connector is in electrical contact with the outboard side of the sensing device beneath the tray. Insulated wires extend between the tray and shield plate from each electrical connector and connect to a common panel mounted electrical connector at one end of the tray.

20 Claims, 5 Drawing Sheets

ANNULAR ELECTRICAL CONNECTOR ASSEMBLY

RELATED PATENT APPLICATIONS

The benefit of the filing date of Provisional Patent Application 60/185,582 filed Feb. 28, 2000 is claimed.

TECHNICAL FIELD

This invention relates to annular electrical connector assembly and more particularly to a sealed annular electrical connector assembly for multiple electrical devices having annular contact rings.

BACKGROUND OF THE INVENTION

It is known to measure cylinder pressure of a combustion engine utilizing a non-intrusive pressure sensing device as disclosed in U.S. Pat. No. 5,329,809 granted to Mark C. Sellanu, Robert G. Plyler and Andrew F. Rodondi, Jul. 19, 1994. A spark plug well within a cylinder head typically mounts threadably and grounds electrically the sensing device. The pressure sensing device comprises a cylindrical metal sleeve forming a concentric channel to mount, seal and shield an annular sensing element within. The sleeve projects the length of the sensor at the inner diameter and provides electrical shielding from high voltage interferences caused by the ignition wires passing through the center of the sensor body.

Sealing the annular sensing element is a lower bonnet having electrical insulating properties. Above the lower bonnet is an electrical contact ring. The contact ring makes electrical contact with the sensing element via a metallic trace which is electrically insulated from the metallic sleeve. Above the contact ring is an upper bonnet. The sleeve flares outwardly above the upper bonnet forming a leading edge. The leading edge holds the sensor assembly together axially.

The annular contact ring of each sensor is electrically isolated from the metallic sleeve portion of each sensor and is connected to an electrical interface. The electrical interface and leading wires must be protected and sealed from the harsh environment surrounding the spark plug wells of a combustion engine cylinder head. In order to achieve a reliable seal, the electrical connector must be capable of adjusting to changing temperatures and varying tolerances.

SUMMARY OF THE INVENTION

Accordingly, the present invention is an electrical connector assembly encircling each spark plug along the length of a combustion engine cylinder head. The electrical connector assembly has a tray containing a plurality of apertures. Each aperture is centered over a pressure sensing device positioned within a cylinder head well about a spark plug. Extending through each aperture is an electrical connector having a housing. The housing has an upper portion and a lower portion with a terminal located between. In resilient engagement between the upper portion and an upper bonnet of the sensing device is an upper seal. The terminal is in electrical contact with a contact ring of the sensing device preferably via tabs protruding inboard of a ring of the terminal. The upper seal forces resiliently the tabs against the contact ring. Preferably, in resilient engagement between the lower portion and a lower bonnet of the sensing device is a lower seal. The combination of the upper seal and the lower seal protects the electrical contact of the tabs and the contact ring from the environment.

The upper portion of the housing is preferably secured to a shoulder of the tray by a flange which permits the housing to float radially during assembly and fixes the housing axially within the aperture. Preferably, a wire lead extends from the terminal through the tray. Each wire lead from each electrical connector is electrically connected to a common panel mounted electrical connector snap fitted to the tray. A shield plate having a plurality of holes, wherein each hole is centered over each aperture, is preferably snap fitted above the wires to the tray. Further, the shield plate is bolted to the cylinder head thereby providing an electrical path to ground electrical interference signals. Once bolted, the housing is radially fixed within the aperture. The spark plugs are accessible through the holes of the shield plate.

A feature of the invention is that the electrical contact between the tabs and the contact ring is isolated and protected from the environment.

Another feature of the invention is an electrical connector with a floating housing to conform to varying tolerances.

Yet another feature of the invention is a shield plate which diminishes high voltage interference and permits maintenance access to the spark plug.

These and other objects, features and advantages of the invention will become more apparent from the following description of a preferred embodiment taken in conjunction with the accompanying drawings.

BRIEF DESCRIPTION OF THE DRAWINGS

The presently preferred embodiment of the invention is disclosed in the following description and in the accompanying drawings wherein.

DETAILED DESCRIPTION OF THE PREFERRED EMBODIMENT

Figure 1:
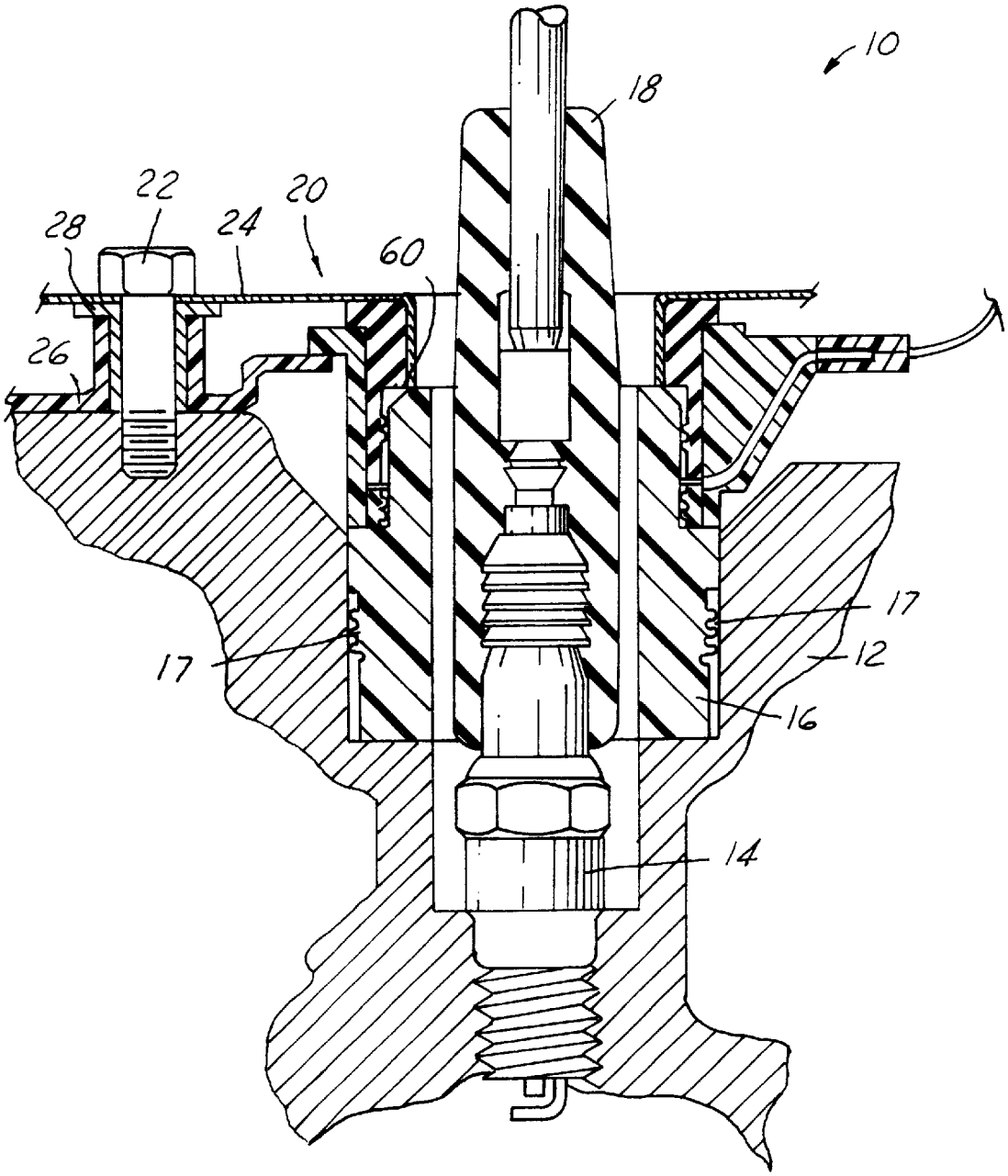
FIG. 1 is a partial cross sectional view of an electrical connector assembly connected to an electrical device about a spark plug environment.

Referring now to FIG. 1 of the drawings, a vehicle engine block assembly 10 is shown having a cylinder head 12 supporting a spark plug 14. Encircling the spark plug 14 is an electrical device 16. Circumscribing the electrical device 16 is the cylinder head 12. A lower portion of the electrical device 16 engages to the cylinder head 12 via threads 17. Electrical device 16 is annular and provides sufficient space so that a spark plug boot 18 can slip over the top and encapsulate the upper portion of the spark plug 14. An outer surface of an upper portion of the electrical device 16 engages to an electrical connector assembly 20 which diminishes electrical interference signals and permits access to the spark plugs 14. Electrical device 16 is, for example, a non-intrusive cylinder pressure sensing device that detects combustion pressure within the corresponding cylinder of a combustion engine.

The electrical connector assembly 20 secures to the cylinder head 12 by a plurality of bolts 22. Each bolt 22 is preferably generally between two spark plugs 14. The bolts 22 extend through a shield plate 24 and a tray 26 of the electrical connector assembly 20, wherein the bolts 22 thread to the cylinder head 12. Because the tray 26 is preferably plastic, each bolt 22 has a compression resistant bushing 28 between the shield plate 24 and the cylinder head 12, preventing damage to the plastic tray 26 when tightening the bolt during assembly. Bolts 22 and bushings 28 are preferably steel and further function as a shielding ground path from the shield plate 24 to the cylinder head 12. The shielding ground path protects against electromagnetic and radio frequency interference.

Figure 2:
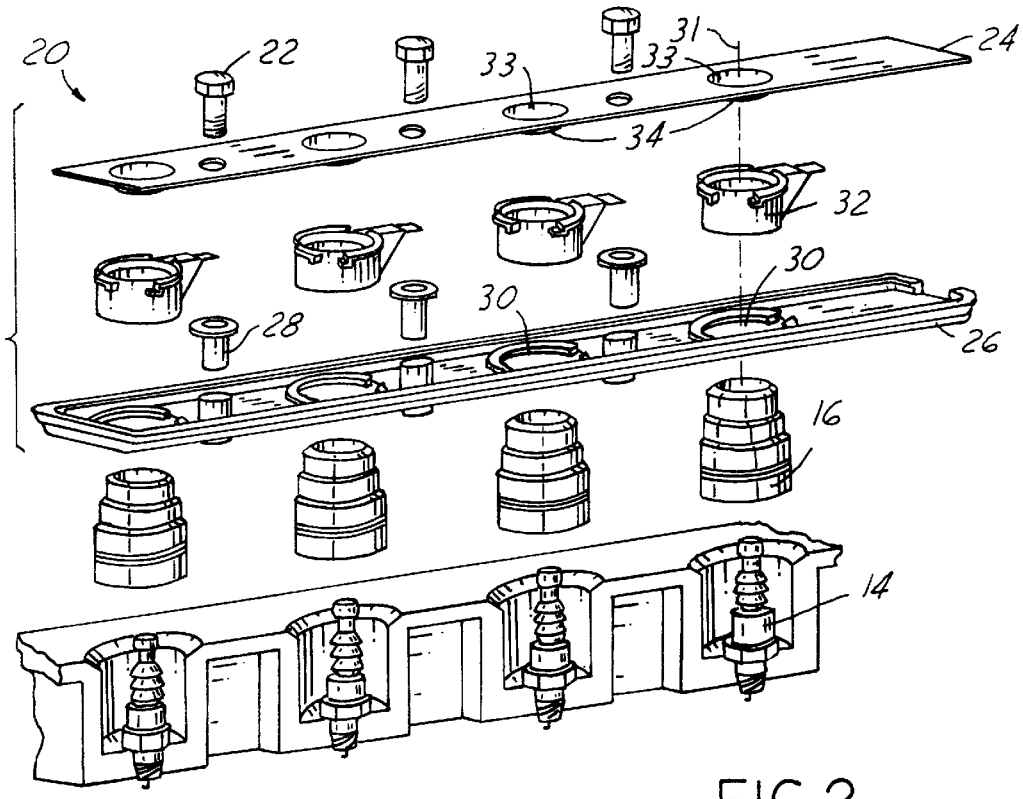
FIG. 2 is an exploded perspective view of the electrical connector assembly and the electrical devices within a spark plug environment.

Referring to FIG. 2, the tray 26 of electrical connector assembly 20 contains a plurality of apertures 30. Each aperture 30 has a centerline 31 and centers over the respective spark plug 14. An electrical connector 32 locks to the tray 26 within each aperture 30. The shield plate 24 covers the tray 26 from above. Shield plate 24 has a plurality of holes 33 each centering about the respective centerline 31. The holes 33 permit access to the spark plug 14 without having to remove the electrical connector assembly 20. Preferably, a plurality of cuffs 34 generally define the plurality of holes 33. Each cuff 34 extends downward and into the respective electrical connector 32 thereby providing a degree of protection of the electrical connector 32 during normal vehicle engine maintenance of the spark plug 14. The cuffs 34 and the electrical connector 32 are generally concentric about the centerline 31. The shield plate 24 and the tray 26 are generally perpendicular to the centerline 31.

Figure 4:
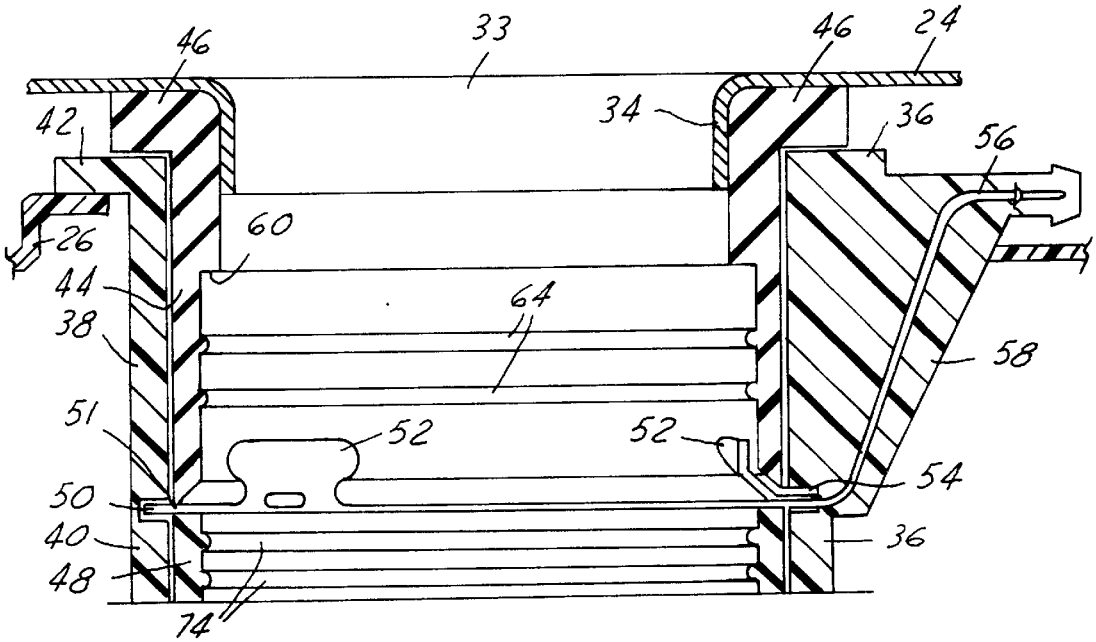
FIG. 4 is a partial cross sectional view of the electrical connector assembly.
Figure 3:
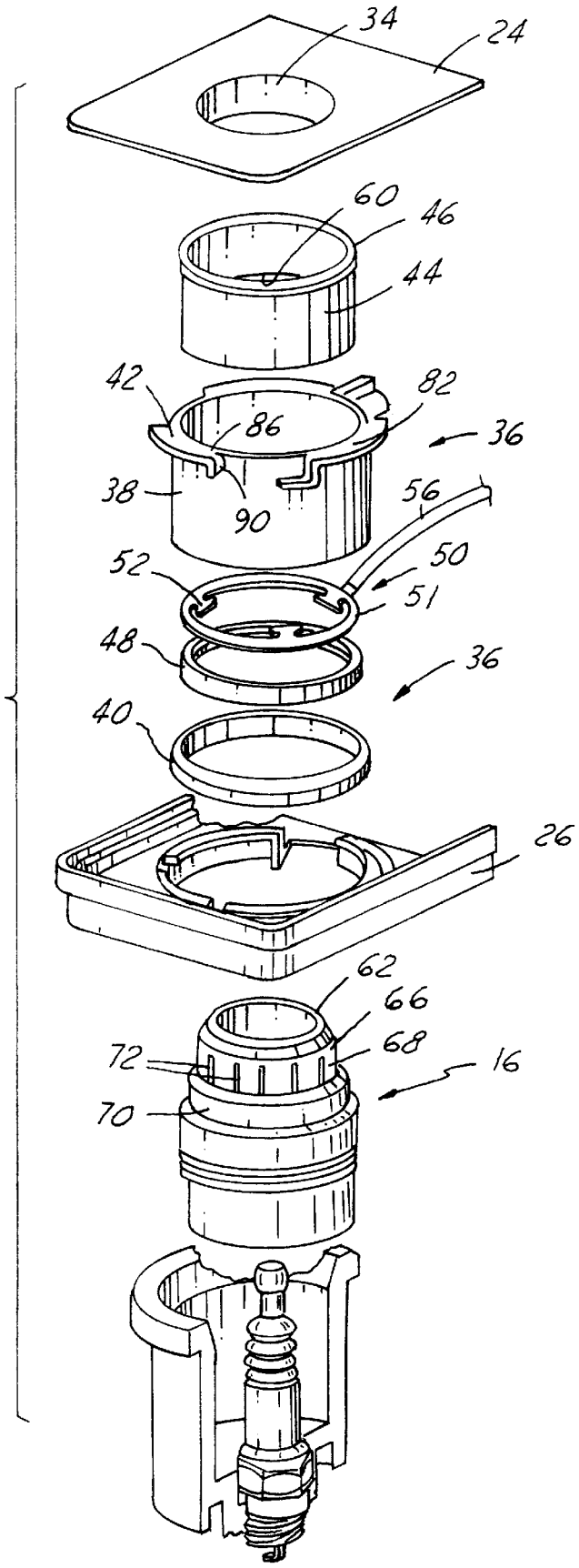
FIG. 3 is an exploded close-up partial perspective view of the electrical connector assembly within a spark plug environment.

Referring to FIGS. 3 and 4, the electrical connector 32 has a housing 36 comprising an upper portion 38 forming to a lower portion 40 possibly by molding or welding. Upper portion 38 has a segmented flange 42 extending radially outward at its free upper end. Segmented flange 42 engages lockably to the tray 26. An upper seal 44 inserts within the upper portion 38 of housing 36. Engaging resiliently between segmented flange 42 of housing 36 and shield plate 24 is an annular flange 46 of the upper seal 44. The cuffs 34 are generally smaller in diameter than the inner diameter portion of the upper seal 44, generally co-located axially with the annular flange 46, to facilitate movement of the connector housing 36 within the tray 26. A lower seal 48 inserts within the lower portion 40 of the housing 36.

Figure 5:
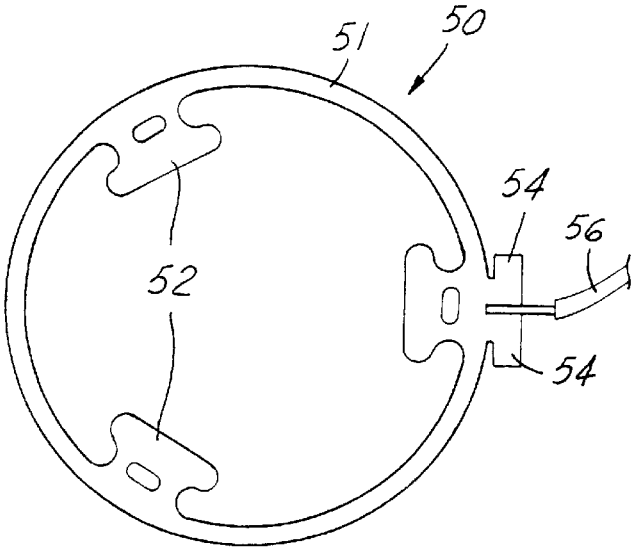
FIG. 5 is a blank view of a terminal of the electrical connector assembly.

Referring to FIGS. 4 and 5, the upper portion 38 and the lower portion 40 mold about a terminal 50 during the assembly process. The terminal 50 has a ring 51 generally outboard of the upper seal 44. At least one contact tab 52 attaches to the ring 51 and extends inboard of the upper seal 44. Terminal 50 also has a crimp tab 54 extending radially outward from the ring 51 to receive a lead wire 56. The lead wire 56 secures electrically to the crimp tab 54 by soldering or welding. A davit 58, projecting outward from housing 36, encases the lead wire 56, as shown in FIG. 4. The lead wire 56 may be an insulated cable or a simple conductor. If lead wire 56 is a simple conductor the davit 58, which is preferably integral to housing 36, provides the necessary electrical insulating protection. Outboard end of the davit 58 exposes the lead wire 56 preferably as a pin or square terminal. Davit 58 preferably forms into an electrical male connection at the outboard end thereby accommodating the pin or square terminal. The housing upper portion 38, the housing lower portion 40, and the davit 58 are integral and preferably mold about the terminal 50 and the lead wire 56 in a single process. The housing 36 is preferably plastic, the terminal 50 is metallic, and the upper and lower seals 44, 48 are preferably silicone. The upper and lower the seals 44, 48 preferably mold into the housing 36 in a single process.

Referring to FIG. 3, when the electrical connector 32 slides axially onto the electrical device 16 from above, a leading edge 62 of the electrical device 16 engages contact tab 52 forcing contact tab 52 to bend upward against the upper seal 44. Upper seal 44 has an inner annular surface 60 which faces downward and engages resiliently a leading edge 62 of the electrical device 16 when in assembly, as best shown in FIG. 1. At least one and preferably a plurality of axially spaced, circumferential, ribs 64 are integral to the upper seal 44 and axially below the annular surface 60. Ribs 64 engage an upper bonnet 66 of electrical device 16 resiliently and circumferentially. Upper bonnet 66 is below the leading edge 62 of electrical device 16.

The electrical device 16 further has a contact ring 68 between the upper bonnet 66 and a lower bonnet 70. The contact ring 68 preferably has a plurality of protrusions 72 equally spaced circumferentially and extending outboard from the contact ring 68. The protrusions 72 have a longitudinal length generally extending axially from the upper bonnet 66 to the lower bonnet 70. The diameter of the lower bonnet 70 is generally larger than the diameter of the upper bonnet 66. In assembly, at least one of the contact tabs 52 of the terminal 50 is in electrical contact with at least one of the protrusions 72. To assure that every contact tab 52 is in electrical contact with a protrusion 72, the width of the contact tab 52 is greater than the distance between protrusions 72. Three contact tabs 52 are preferred for reliable electrical engagement, and the contact tabs 52 are preferably plated.

In assembly, the contact tabs 52 are generally perpendicular to, and extend upward from, the ring 51 of the terminal 50, as best shown in FIG. 4. Contact tabs 52 are radially between the upper seal 44 and the contact ring 68 of the electrical device 16. Furthermore, contact tabs 52 are axially below circumferential sealing ribs 64. The upper seal 44 resiliently forces the contact tabs 52 against the protrusions 72. The lower seal 48 is generally below the terminal 50. The lower seal 48 has at least one and preferably a plurality of axially spaced circumferential lips 74 protruding inwardly and engaging circumferentially the lower bonnet 70 of electrical device 16. The circumferential sealing ribs 64 and lips 74 isolate contact tabs 52 and protrusions 72 from the outside environment thereby keeping the electrical engagement free of dirt and moisture, as best shown in FIGS. 1 and 4.

Referring to FIGS. 3, 6, 7 and 8, the housing 36 attaches to tray 26 by inserting housing 36 into one of the apertures 30 until the segmented flange 42 of housing 36 touches a raised shoulder 76 of tray 26. Full engagement to tray 26 occurs upon clockwise rotation of housing 36 while exerting a downward force. Shoulder 76 has a sleeve 78 which extends upward from the bottom of tray 26 and generally circumscribes the aperture 30. A segmented ledge 80 secures rigidly to the top of sleeve 78. Segmented ledge 80 is generally annular, extends radially inward, and is substantially perpendicular to sleeve 78.

After segmented flange 42 touches shoulder 76 and during rotation, segmented flange 42 interlaces axially with the segmented ledge 80 preventing axial movement of housing 36 with respect to tray 26, while permitting limited radial movement for ease of positioning the electrical connector assembly 20 about the electrical devices 16. This robust design of electrical connector assembly 20 preferably permits up to about 1 mm of connector housing 36 movement within tray 26 and with respect to the electrical device 16 in any one direction from the centerline 31. This movement substantially ceases when the shield plate 24 engages to the annular flange 46 of the upper seal 44 and bolts 22 are tightened down upon shield plate 24 and bushings 28. Incorporation of this movement into the design relieves manufacturing tolerances of the tray 26 otherwise necessary for assembly, and permits a limited degree of tray 26 expansion and contraction against upper seal 44 with changing temperature and environmental conditions during normal operation.

Figure 6:
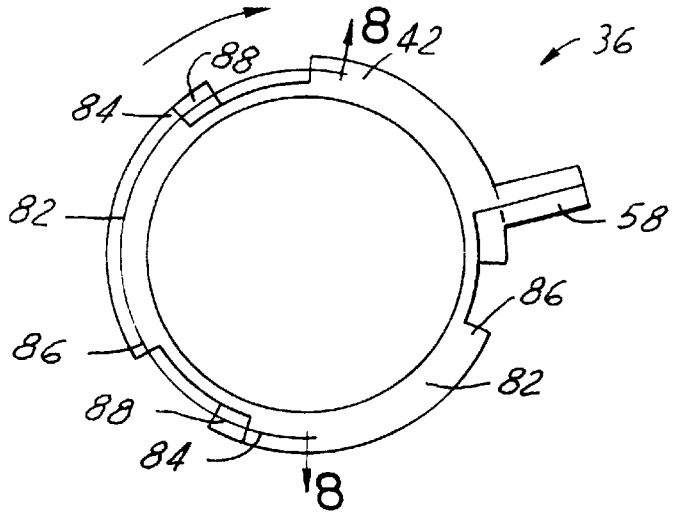
FIG. 6 is a top view of a housing of the electrical connector assembly.
Figure 8:
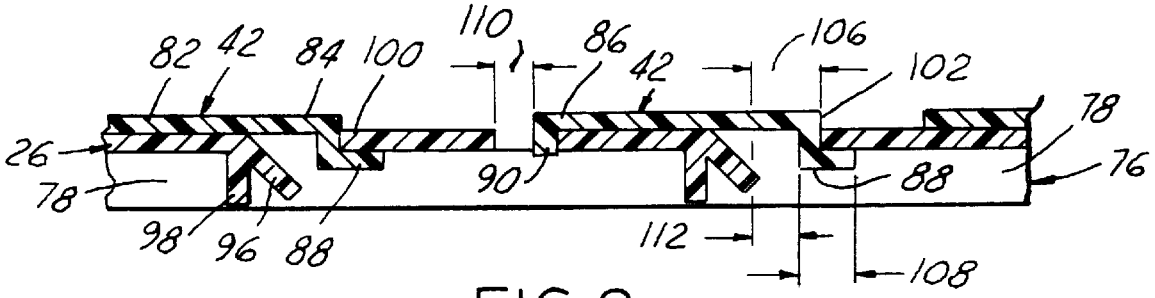
FIG. 8 is a partial cross-sectional view of a subassembly comprising the housing and the tray shown in FIG. 6 and FIG. 7.

Referring to FIGS. 6 and 8, segmented flange 42 has at least one and preferably two locking members 82 having a leading end 84 and a trailing end 86. A depressed shelf 88 secures rigidly to the leading end 84. Depressed shelf 88 secures rigidly and is generally perpendicular to housing 36. An extension 90 secures rigidly to the trailing end 86 and extends generally downward. Every locking member 82 does not necessarily have both a depressed shelf 88 and an extension 90 unless only one locking member 82 is incorporated into segmented flange 42. At least one depressed shelf 88 and at least one extension 90 are required within the segmented flange 42 in its totality.

Figure 7:
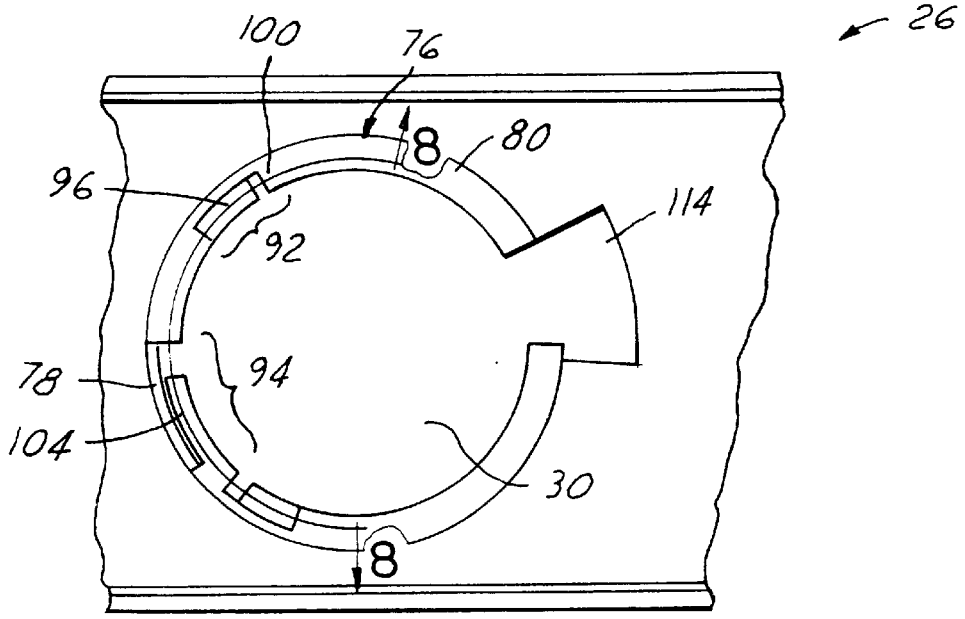
FIG. 7 is a partial top view of a tray of the electrical connector assembly.

Referring to FIGS. 7 and 8, the segmented ledge 80 of shoulder 76 of tray 26 has at least one forward stop portion 92 (from a clockwise perspective) for engaging the depressed shelf 88 of segmented flange 42, and a rearward stop portion 94 for engaging the extension 90 of segmented flange 42. Forward and rearward stop portions 92, 94 both configure circumferentially about aperture 30.

The forward stop portion 92 has a ramp 96 sloping circumferentially downward in the clockwise direction. Ramp 96 attaches rigidly to the inboard side of sleeve 78 and extends radially inward therefrom. To vertically support ramp 96, a support member 98 attaches rigidly to the inboard side of sleeve 78 and the bottom side of ramp 96. The longitude of support member 98 generally extends axially. Forward from the ramp 96 by a circumferential first distance 106 is a forward stop edge 100 of the forward stop portion 92. A second distance 108 is the circumferential length of the depressed shelf 88 of segmented flange 42. The first distance 106 must be larger than the second distance 108 to permit axial passage of the depressed shelf 88 when the housing 36 inserts into aperture 30 and rotates clockwise as indicated by the arrow in FIG. 6. The slope of ramp 96 assists in guiding the depressed shelf 88 below the forward stop edge 100 of segmented ledge 80 until the bottom side of the segmented flange 42 engages the top side of segmented ledge 80 tightly. Continued clockwise rotation of the housing 36 ceases when forward stop edge 100 of segmented ledge 80 contacts a vertical member 102 of segmented flange 42. The longitude of vertical member 102 generally extends axially. To provide vertical support of the segmented flange 42 and the depressed shelf 88, an upward end of vertical member 102 preferably attaches rigidly to segmented flange 42 and a downward end attaches rigidly to the top side of the trailing end of the depressed shelf 88.

The rearward stop portion 94 has a cantilevered arm 104, wherein the longitude extends circumferentially inboard of the sleeve 78. A rearward end of the arm 104 secures rigidly to segmented ledge 80, and the forward end is free. When the depressed shelf 88 rotates downward upon the ramp 96, the extension 90 of trailing end 86 of segmented flange 42 contacts the arm 104 from above (not shown). As the housing 36 rotates downward, the extension 90 slides along arm 104 toward the free end, thereby flexing the arm 1704 ever further downward as housing 36 rotates downward, until extension 90 rotates beyond the free end of arm 104, whereby the arm 104 snaps back into a planar arrangement with the remainder of segmented ledge 80.

When the extension 90 of the housing 36 snaps into an assembled arrangement with the shoulder 76 of the tray 26, housing 36 thereby locks to tray 26. Any counterclockwise movement of the housing 36 is limited by the extension 90 when contacting the free end of arm 104. To remain locked, a third length 110, measuring forward from the free end of arm 104 to the trailing side of extension 90, must be less than a fourth length 112, measuring forward from the leading side of ramp 96 to the trailing end of depressed shelf 88. Third length 110 and fourth length 112 are shown in FIG. 8 with the housing 36 in a fully clockwise locked position.

In order to receive the davit 58 of the housing 36, the shoulder 76 has a key slot 114 in communication with the aperture 30. Key slot 114 generally extends through the sleeve 80 and into the tray 26. The circumferential width of key slot 114 is dependent upon the degrees of rotation required to lock the housing 36 to the tray 26. Since the angle of rotation is preferably ten to twenty degrees about the centerline 31 of the aperture 30, the width of key slot 114 is ten to twenty degrees plus the width of the davit 58 at the tray 26 planar location.

Figure 9:
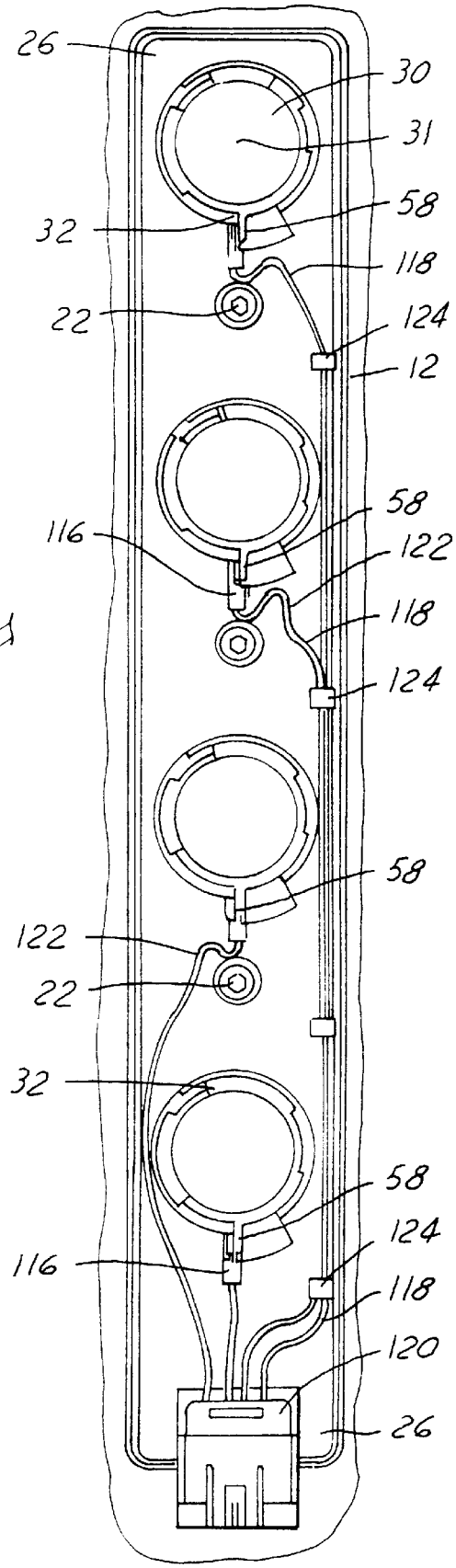
FIG. 9 is a top view of the electrical connector assembly with a shield plate removed to show internal detail.

Referring to FIG. 9, the electrical connector assembly 20 is shown as having four electrical connectors 32 and three bolts 22 securing the tray 26 to the cylinder head 12. For each electrical connector 32, a mating female connector 116 snap fits to the preferred male connector of the davit 58. The lead wire 56 of each electrical connector 32 thereby connects electrically with an insulated wire 118. Each insulated wire 118 routes within the tray 26 to a panel mounted connector 120 which snap fits in a passage through an end wall of the tray 26. The shield plate 24 shown in FIGS. 1, 2 and 3 protect the insulated wires 118 within the tray 26. A plurality of paired nubbins 122 and wire holders 124 generally project upward from the bottom of tray 26 to secure the insulated wires 118 to the tray 26. Insulated wires 118 snap fit into the paired nubbins 122 and routed beneath the wire holders 124 as shown in FIG. 9.

Although the preferred embodiment of the present invention has been disclosed, various changes and modifications may be made thereto by one skilled in the art without departing from the scope and spirit of the invention as set forth in the appended claims. It is also understood that the terms used herein are merely descriptive, rather than limiting, and that various changes may be made without departing from the scope and spirit of the invention.

We claim:

1. An electrical connector assembly for an electrical device, the electrical connector assembly comprising:

a tray having a plurality of apertures, each aperture having a centerline, the centerline perpendicular to the tray;

an electrical connector centered through each aperture and disposed radially outward from the electrical device, the electrical connector having a housing having an upper portion engaged to the tray, an upper seal adapted to be resiliently engaged radially between the electrical device and the upper portion of the housing, and a terminal disposed below the upper portion of the housing, the terminal adapted to be in electrical contact with the electrical device;

the housing having a lower portion located below the upper portion and concentric about the center line, the terminal disposed substantially between the upper and lower portions; and a lower seal resiliently disposed radially between the electrical device and the lower portion of the housing.

2. The electrical connector assembly as set forth in claim 1 further comprising a shield plate having a plurality of holes concentrically located over the plurality of apertures of the tray.

3. The electrical connector assembly as set forth in claim 2 further comprising:

the tray having a shoulder circumscribing each aperture;

the upper portion of the housing having a flange extending radially outward, the flange engaged to the shoulder from above, the housing capable of radial movement within the aperture while being held axially fixed prior to assembly of the shield plate; and the upper seal having an annular flange extending radially outward, the annular flange resiliently disposed between the housing flange and the shield plate.

4. The electrical connector assembly as set forth in claim 3 further comprising:

the shoulder of the tray having a sleeve and a segmented ledge, the sleeve extended upward from the tray, the segmented ledge extended radially inward and rigidly attached to the inboard side of the sleeve, the segmented ledge having at least one forward stop portion and at least one rearward stop portion positioned circumferentially about the aperture; and the flange of the housing being segmented, the segmented flange having at least one locking member having a leading end and a trailing end, the leading end contacts the forward stop portion of the segmented ledge to limit clockwise rotation of the housing within the aperture and the trailing end contacts the rearward stop portion to limit counterclockwise rotation of the housing within the aperture.

5. The electrical connector assembly as set forth in claim 4 further comprising:

the forward stop portion of the segmented ledge having a ramp and a forward stop edge, the ramp sloped downward in the forward clockwise direction and attached rigidly to the sleeve, the forward stop edge positioned forward of the ramp by a first length, the first length coplanar with the shoulder;

the rearward stop portion of the segmented ledge having a arm, the arm extended circumferentially forward about the aperture, the arm positioned inboard of and perpendicular to the sleeve;

the leading end of the locking member of the segmented flange having a depressed shelf and a vertical member, the depressed shelf disposed axially below the forward stop edge, the depressed shelf coplanar with the shoulder, the depressed shelf having a second length wherein the second length is less than the first length, the vertical member disposed axially, connecting the segmented flange to the depressed shelf;

the trailing end of the locking member having an extension projected downward from the segmented flange, the arm in resilient contact with the extension during the downward clockwise rotation of the housing to the tray, the arm positioned coplanar to the shoulder when the extension is forward of the arm and the depressed shelf is below the forward stop edge;

a third length defined as the circumferential distance between the arm and the extension when the housing is rotated fully clockwise; and a fourth length defined as the circumferential distance between the ramp and the vertical member when the housing is rotated fully clockwise, the fourth length greater than the third length.

6. The electrical connector assembly as set forth in claim 5 wherein the ramp is further supported by a support member extended radially inward from the sleeve, the support member positioned below and attached to the ramp.

7. The electrical connector assembly as set forth in claim 6 wherein the terminal has a ring and at least one tab, the ring encased radially between the upper and lower portions of the housing, the at least one tab extended radially inward and upward from the ring, the at least one tab disposed between the upper seal and the electrical device, the at least one tab held resiliently against the electrical device by the upper seal.

8. An electrical connector assembly for an electrical device having a leading edge, an upper bonnet, a contact ring having a plurality of protrusions, and a lower bonnet, the electrical connector assembly comprising:

a tray having a plurality of apertures, each aperture having a centerline perpendicular to the tray;

an electrical connector disposed through each aperture, the electrical connector having:

a housing engaged to the tray, the housing having an upper portion and a lower portion, the upper and lower portions concentric about the centerline of the aperture, an upper seal resiliently disposed radially between the upper bonnet of the electrical device and the upper portion of the housing, a lower seal resiliently disposed radially between the lower bonnet of the electrical device and the lower portion of the housing, and a terminal having a ring and at least one tab, the ring disposed axially between the upper and lower portions of the housing, the at least one tab extended radially inward and upward from the ring, the at least one tab disposed between the upper seal and the plurality of protrusions of the contact ring, the at least one tab held resiliently against the protrusions by the upper seal;

a shield plate having a plurality of holes concentrically located about the centerline over the plurality of apertures of the tray; and a panel mounted connector snap fitted to the tray and in electrical contact with each terminal.

9. The electrical connector assembly as set forth in claim 8 wherein the terminal has a crimp tab and a lead wire, the crimp tab projecting radially outward from the ring, the lead wire in electrical contact between the crimp tab and the panel mounted connector.

10. The electrical connector assembly as set forth in claim 9 further comprising:

the housing having a davit, the davit extended radially outward and axially from the terminal through the tray, the lead wire encased by the davit up through the tray; and the tray having a key slot, the davit extended through the key slot, the lead wire exposed through the davit above the tray, each lead wire in electrical contact with the panel mounted connector.

11. The electrical connector assembly as set forth in claim 10 wherein the davit is formed integrally into a male connector positioned above the tray and below the shield plate, the lead wire exposed within the male connector.

12. The electrical connector assembly as set forth in claim 11 wherein the electrical contact with the panel mounted connector is completed by a female connector snap fitted to the male connector, the female connector having an insulated wire, the insulated wire extended away from the female connector and into the panel mounted connector.

13. The electrical connector assembly as set forth in claim 12 wherein the tray has a plurality of paired nubbins projected upwardly, the insulated wires snap fitted to the paired nubbins.

14. The electrical connector assembly as set forth in claim 13 wherein the shield plate has a plurality of cuffs defining the plurality of holes, the cuffs extended downward and concentrically located over the plurality of apertures of the tray, each cuff disposed radially inboard of the upper seal.

15. An electrical connector assembly as set forth in claim 14 wherein the shield plate has a plurality of bolts, each bolt having a bushing, the plurality of bolts positioned intermittent to the plurality of holes of the shield plate, the shield plate, the bushings, and the tray penetrated by the bolts, the bushings located between the shield plate and the tray, the bolts threaded into a cylinder head of an engine.

16. The electrical connector assembly as set forth in claim 8 further comprising:

the upper seal having at least one rib engaged circumferentially resiliently about the upper bonnet, the at least one rib axially disposed above the at least one tab; and the lower seal having at least one lip engaged circumferentially resiliently about the lower bonnet, the diameter of the upper bonnet being less than the diameter of the lower bonnet.

17. The electrical connector assembly as set forth in claim 16 further comprising:

the tray having a shoulder circumscribing each aperture;

the upper portion of the housing having a flange extended radially outward, the flange engaged to the shoulder from above, the housing capable of radial movement within the aperture while being axially fixed prior to assembly of the shield plate; and the upper seal having an annular flange disposed above the at least one rib, the annular flange extended radially outward, the annular flange disposed resiliently between the housing flange and the shield plate.

18. The electrical connector assembly as set forth in claim 17 wherein the upper seal has an inner annular surface positioned below the annular flange and above the at least one rib, the leading edge of the electrical device engaged resiliently to the inner annular surface.

19. The electrical connector assembly as set forth in claim 18 wherein the upper portion and the lower portion of the housing are plastic and co-molded about the terminal, and the upper seal and lower seal are silicone and co-molded in the same molding operation with the housing.

20. An electrical connector assembly for an electrical device, the electrical connector assembly comprising:

a tray having a plurality of apertures, each aperture having a centerline, the centerline perpendicular to the tray;

an electrical connector centered through each aperture and disposed radially outward from the electrical device, the electrical connector having a housing having an upper portion engaged to the tray, an upper seal adapted to be resiliently engaged radially between the electrical device and the upper portion of the housing, and a terminal disposed below the upper portion of the housing, the terminal adapted to be in electrical contact with the electrical device; and the terminal having a ring and a tab, the ring disposed axially below the upper portion, the tab extended radially inward and upward from the ring, the tab disposed radially between the upper seal and the electrical device, the tab held resiliently against the electrical device by the upper seal.

* * * * *